US007578365B2

(12) United States Patent
Kurtz, Jr. et al.

(10) Patent No.: US 7,578,365 B2
(45) **Date of Patent: *Aug. 25, 2009**

(54) SKID STEER REAR DOOR AND CHASSIS INTERLOCK

(75) Inventors: Robert D. Kurtz, Jr., Leola, PA (US); Clayton E. Banks, Jr., Brownstown, PA (US)

(73) Assignee: CNH America LLC, New Holland, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/879,358

(22) Filed: Jul. 17, 2007

(65) Prior Publication Data

US 2008/0029321 A1 Feb. 7, 2008

Related U.S. Application Data

(62) Division of application No. 10/873,798, filed on Jun. 22, 2004, now Pat. No. 7,261,173.

(51) Int. Cl.
*B62D 25/10* (2006.01)

(52) U.S. Cl. ..... 180/69.2; 180/69.21

(58) Field of Classification Search ..... 180/69.2, 180/69.21, 68.6, 68.1, 69.24; 123/41.43, 123/41.51; 165/51, 137
See application file for complete search history.

(56) References Cited

U.S. PATENT DOCUMENTS 3,743,045 A 7/1973 Hansen
3,865,210 A 2/1975 Von Fummetti et al.
4,322,107 A 3/1982 Ishizuka et al.
4,371,048 A 2/1983 Hansen
4,415,052 A 11/1983 Gauer
4,443,236 A * 4/1984 Peiler ..... 180/68.1
4,848,498 A 7/1989 Hart et al.
5,599,057 A 2/1997 Hirahara et al.
5,645,134 A 7/1997 Frankel et al.
5,947,540 A 9/1999 Pariseau et al.
6,058,903 A 5/2000 Downham
6,405,825 B1 6/2002 Yabe et al.
6,589,307 B2 * 7/2003 Jaramillo et al. ..... 55/385.3
6,655,486 B2 12/2003 Oshikawa et al.
6,663,166 B2 12/2003 Achleitner
7,261,173 B2 * 8/2007 Kurtz et al. ..... 180/69.2

* cited by examiner

*Primary Examiner*—Hau V Phan
(74) *Attorney, Agent, or Firm*—Michael G. Harms; John William Stader; Patrick M. Sheldrake

(57) ABSTRACT

An interlock for a skid steer vehicle with a rear engine compartment and a rear door to that compartment includes a beam that is mounted transversely to the bottom of the door and has an upward facing surface that, like the beam, extends across the entire rear engine compartment opening. An interlocking second member is fixed to the chassis and extends across the rear engine compartment opening. When the door is impacted and forced upward, the first beam engages the second interlocking member over its width and transfers the force from the door (and beam) to the chassis When the door is impacted with a forward-directed force, the first beam also contacts the second member and transfers the forward forces through the second member to the chassis. Injury to the door is reduced or eliminated by transferring door impact forces to the chassis since the first beam extends substantially the entire distance across the door and is fixed to an inner surface of the door's frame.

7 Claims, 5 Drawing Sheets

SKID STEER REAR DOOR AND CHASSIS INTERLOCK

This divisional application claims priority under 35 U.S.C. § 120 from U.S. patent application Ser. No. 10/873,798 filed on Jun. 22, 2004 now U.S. Pat. No. 7,261,173 by Robert D. Kurtz Jr., et al. with the same title, the full disclosure of which is hereby incorporated by reference.

FIELD OF THE INVENTION

The present invention generally relates to skid steer vehicles. More particularly, it relates to rear doors for skid steer vehicles.

BACKGROUND OF THE INVENTION

Skid steer vehicles such as skid steer loaders are a mainstay of construction work. In their most common configuration, they have two drive wheels on each side of a chassis that are driven in rotation by one or more hydraulic motors coupled to the wheels on one side and another one or more hydraulic motors coupled to the wheels on the other side.

The wheels on one side of the vehicle can be driven independently of the wheels on the other side of the vehicle This permits the wheels on opposing sides of the vehicle to be rotated at different speeds and in opposite directions. By rotating in opposite directions, the skid steer can rotate in place about a vertical axis that extends through the vehicle itself.

The vehicles have an overall size of about 10 by 12 feet, which, when combined with their ability to rotate in place, gives them considerable mobility at a worksite. It is this mobility that makes them a favorite.

Skid steer vehicles commonly have at least one loader (or lift) arm that is pivotally coupled to the chassis of the vehicle to raise and lower at the operator's command. This arm typically has a bucket, blade or other implement attached to the end of the arm that is lifted and lowered thereby. Most commonly, a bucket is attached, and the skid steer vehicle is used to carry supplies or particulate matter such as gravel, sand, or dirt around the worksite.

As a counterbalance to the loads provided at the front of the vehicle, skid steer vehicles typically have an engine that is located behind the operator. The radiator is also commonly disposed behind the operator, usually at the center rear of the vehicle.

A door or other access hatch is located at the very back of the vehicle to give the operator access to the engine and radiator from the very rear of the vehicle. Other doors and hatches may be disposed down the side of the vehicle or engine compartment instead of the rear to provide additional access.

One difficulty with rear engine access doors is their susceptibility to impact. Skid steer vehicles typically have a restricted view to the rear, preventing the operator from seeing behind the vehicle. Skid steer vehicles also spend a substantial amount of time traveling in reverse is close quarters. Skid steer vehicles are often operated in a rapid back-and-forth movement, making what are called "Y turns" as they move material from one pile to another perhaps several hundred times a day.

As a result, operators often misjudge the distance between the rear of the vehicles and obstacles and occasionally back skid steer vehicles into these obstacles, albeit at very slow speeds. Whenever a skid steer with a rear engine compartment door impacts an obstacle it is the door that suffers.

Even when the door is not damaged, however, the door hinges an the door latch may be damaged. The forces involved may not be great enough the actually damage the door itself, but it is often significant enough to tear or bend the hinges and latch, thereby either removing the door entirely, or jamming the door shut in its closed position What is needed, therefore, is an improved skid steer vehicle having a door that is resistant to being damaged. What is also needed is a skid steer vehicle with a means for protecting the door hinges from upward rear impacts. What is also needed is a skid steer door that automatically protects the hinges without requiring additional operator input. What is also needed is a means for transmitting potentially damaging forces acting against the rear door directly to the frame or chassis. It is an object of this invention to provide these advantages. While not every claimed aspect of the invention provides all these advantages, each of these advantages is provided by at least one claimed aspect.

SUMMARY OF THE INVENTION

In accordance with a first aspect of the invention, a rear door and chassis interlock for a skid steer vehicle is provided, including a first elongated and laterally-extending beam fixed to a door frame of the rear door of a skid steer vehicle, the first beam having a generally horizontal and upwardly-facing surface; and a second elongated and laterally-extending beam fixed to a rear chassis of the skid steer vehicle, the second beam having a generally horizontal and downwardly facing surface; wherein the upwardly-facing surface and the downwardly-facing surface interlock over substantially their entire lateral extent to reduce upward movement of the rear door with respect to the chassis.

The second beam may be fixed to and extend between two elongated chassis members disposed on either side of the engine. The first and second beams may extend substantially the entire width of a rear-facing opening of an engine compartment and may be interlocked over substantially the entire width of the opening, The first beam may have a box structure and may include an "L"-shaped angle bracket fixed to a forward surface thereof, and the angle bracket may extend laterally across the vehicle and may have the generally horizontal and upwardly-facing surface that is configured to interlock with generally horizontal and downwardly facing surface of the second beam The upper surface of the angle bracket may extend across substantially the entire width of the engine compartment. The first beam may include a generally vertical, forward-facing and laterally extending surface to which the angle bracket is fixed, the forward-facing surface may have a first surface portion that extends above the angle bracket that may be spaced closely enough to a rearward edge of the second beam to transmit the force of forward impacts to the second beam. The first and second beams may be spaced a distance apart sufficient that they engage one another when the door is lifted before hinges supporting the door on the vehicle and a latch holding the door closed are damaged.

In accordance with a second aspect of the invention, a rear engine compartment for a skid steer vehicle is provided, including a left sidewall, a right sidewall, and a top wall that are fixed to a chassis of the skid steer vehicle and are disposed to enclose the engine an define a rear opening to the engine compartment; a first elongated and laterally-extending beam fixed to the chassis, the first beam having a generally horizontal and downwardly facing surface extending from the rear opening; and a rear door pivotally coupled to a chassis of the vehicle, the door including a door frame and a second elongated and laterally-extending beam fixed to the door frame, the second beam having a generally horizontal and upwardly-facing surface, wherein the rear door is disposed to cover the rear opening and is supported by two hinges and a latch; wherein the upwardly-facing surface and the downwardly-facing surface interlock over substantially their entire lateral extent to reduce upward movement of the rear door with respect to the chassis.

The first beam may be fixed to and extend between two elongated chassis members disposed on either side of the engine. The first and second beams may extend substantially the entire width of the rear opening, and may be interlocked over substantially the entire width of the opening. The second beam may have a box structure and includes an "L"-shaped angle bracket fixed to a forward surface thereof, and the angle bracket may extend laterally across the vehicle and may have the generally horizontal and upwardly-facing surface that is configured to interlock with generally horizontal and downwardly facing surface of the first beam. The upper surface of the angle bracket may extend across substantially the entire width of the engine compartment. The second beam may include a generally vertical, forward-facing and laterally extending surface to which the angle bracket is fixed, and the forward-facing surface may have a first surface portion that extends above the angle bracket that is spaced closely enough to a rearward edge of the first beam to transmit the force of forward impacts to the first beam. The first and second beams may be spaced a distance apart sufficient that they engage one another when the door is lifted before hinges supporting the door on the vehicle and a latch holding the door closed are damaged.

In accordance with a third aspect of the invention, a rear chassis for a skid steer vehicle is provided, including a rear door including a door frame and a first elongated and laterally-extending energy-transmitting beam transversely fixed to the bottom of the door frame, the first beam having a generally horizontal and upwardly-facing surface; and a rear chassis including left and right longitudinally extending frame members, and a left side panel, right side panel and top panel fixed to the frame members to enclose the engine, the rear chassis also including a second elongated and laterally-extending beam, the second beam having a generally horizontal and downwardly facing surface; wherein the rear door is pivotally coupled to one side of the engine compartment with hinges, and further wherein the door is secured in a closed position by a latch; and wherein the upwardly-facing surface and the downwardly-facing surface interlock over substantially their entire lateral extent to reduce upward movement of the rear door with respect to the chassis.

The second beam may extend across a rear engine compartment opening that is defined between the left and right side panels and the top panel. The first and second beams may extend substantially the entire width of rear engine compartment opening and may be interlocked over substantially the entire width of the opening. The first beam may have a box structure and may include an angle bracket fixed to a forward surface thereof, and the angle bracket may extend laterally across the door frame and may define the generally horizontal and upwardly-facing surface. The upper surface of the angle bracket may extend across substantially the entire width of the opening. A portion of the first beam may be disposed slightly forward of a portion of the second beam to reduce door damage by transmitting the force of forward impacts from the door to the second beam. The first and second beams may be spaced a distance apart sufficient that they engage one another when the door is lifted before hinges supporting the door on the vehicle are damaged.

Numerous other features and advantages of the present invention will become readily apparent from the following detailed description, the accompanying drawings, and the appended claims.

DETAILED DESCRIPTION OF THE PREFERRED EMBODIMENTS

Figure 1:
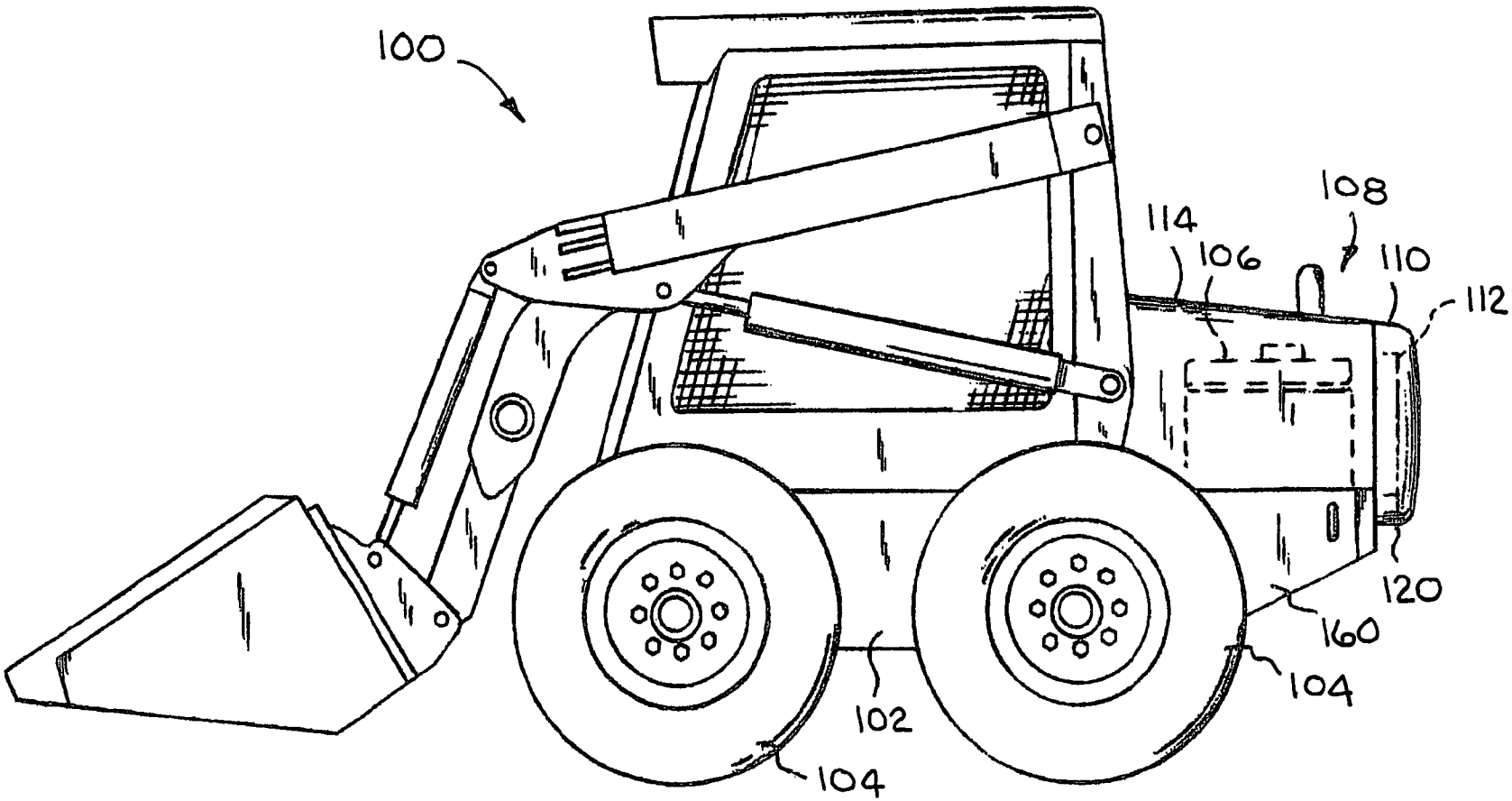
FIG. 1 is a left side view of a skid steer vehicle in accordance with the present invention.
Figure 2:
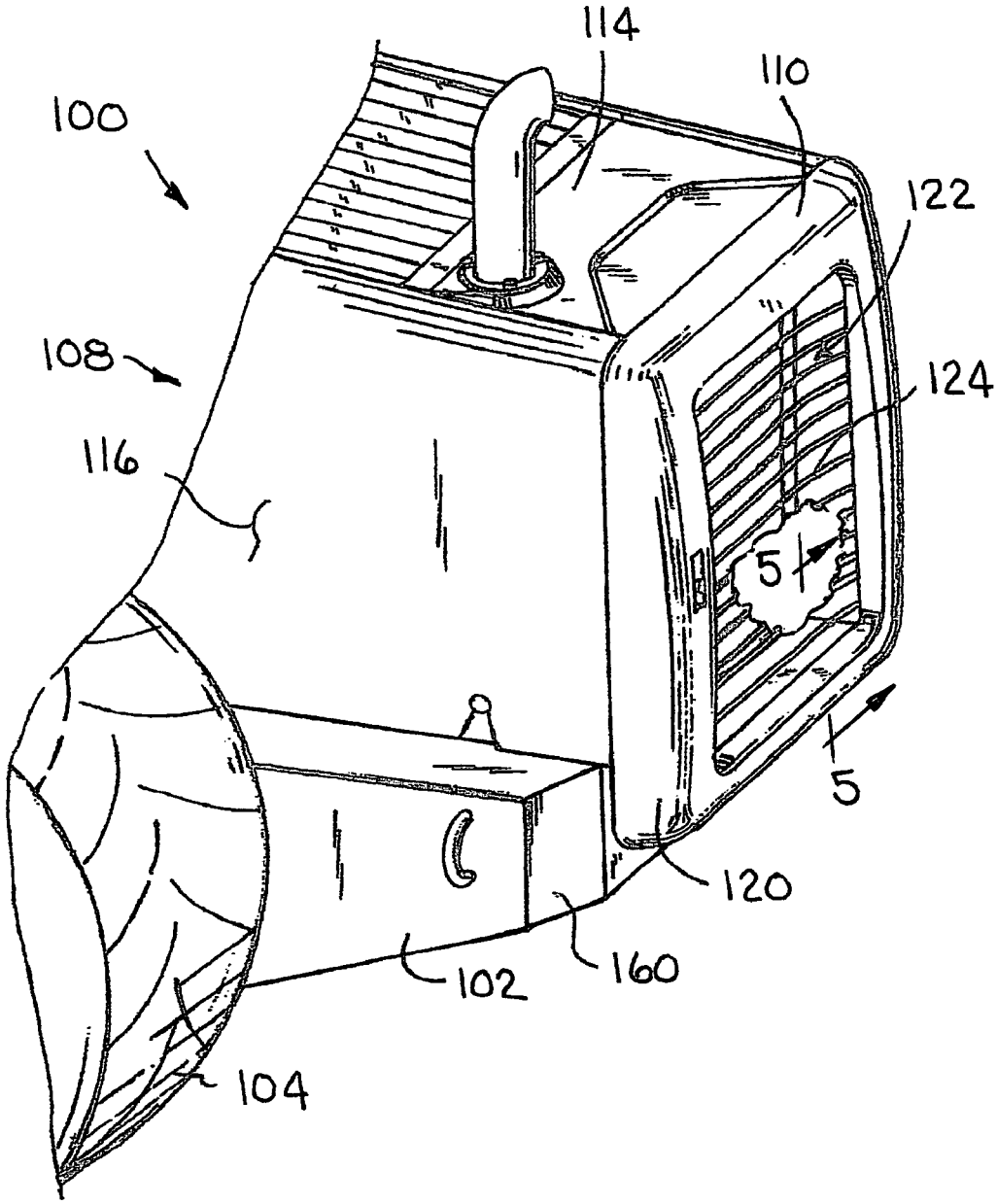
FIG. 2 is a fragmentary left side perspective rear view of the vehicle of FIG. 1 with the rear door closed.

While the present invention is susceptible of being made in any of several different forms, the drawings show a particularly preferred form of the invention. One should understand, however, that this is just one of many ways the invention can be made. Nor should any particular feature of the illustrated embodiment be considered a part of the invention, unless that feature is explicitly mentioned in the claims. In the drawings, like reference numerals refer to like parts throughout the several views.

Referring now to the FIGURES, there is illustrated a skid steer vehicle 100. The vehicle includes a chassis 102 on which are mounted four wheels (two shown) 104. These wheels are disposed two on each side in a fore-and-aft relationship. All the wheels are drive wheels, driven by engine 106 that is disposed in a rear engine compartment 108 of vehicle 100.

Engine compartment 108 encloses engine 106, surrounding it on all four sides as well as its top. A rear engine compartment door 110 encloses the rear of the engine compartment and protects a transversely-mounted rear radiator 112 that is fixed to the chassis behind the engine.

The engine compartment 108 includes a top panel 114, a left side panel 116, and a right side panel 118. These panels enclose not only the engine 106, but the radiator 112 as well. The left panel is fixed to and supported by an elongated and longitudinally-extending left side chassis member 160 which can be seen best in FIG. 1. The right panel is fixed to and supported by an elongated and longitudinally extending right side chassis member 136 that is configured identically to left side chassis member 160, but is disposed along the right side of the chassis and is configured as a mirror image of member 160. Chassis members 160 and 136 extend backward along both sides of engine 106, which is fixed to both members.

Door 110 seals against top panel 114 as well as side panels 116, and 118 to provide protection both from the elements and from rigid objects that might damage the engine and radiator if the operator backs vehicle 100 backs up into them.

Door 110 is in the form of a rectangular frame 120 having a central rectangular opening 122. Opening 122 is covered with louvers 124 that are disposed vertically across the aperture formed by the opening. These louvers can be pivoted about their longitudinal axes to abut one another and close opening 122, or alternatively to open and permit air to pass therethrough. In this manner, the operator can regulate the amount of cooling provided by the radiator, which is disposed right behind door 110.

Door 110 is supported by two hinges, an upper hinge 126 and a lower hinge 128. The upper hinge includes two hinge plates 130,132 (FIG. 4), and a pin (not shown) pivotally coupling the two plates together. Hinge plate 130 is bolted to a vertical member 134 that in turn is bolted to right side chassis member 136. Plate 132 is fixed to door frame 120 and pivots together with the frame of the door when the door is opened.

Figure 3:
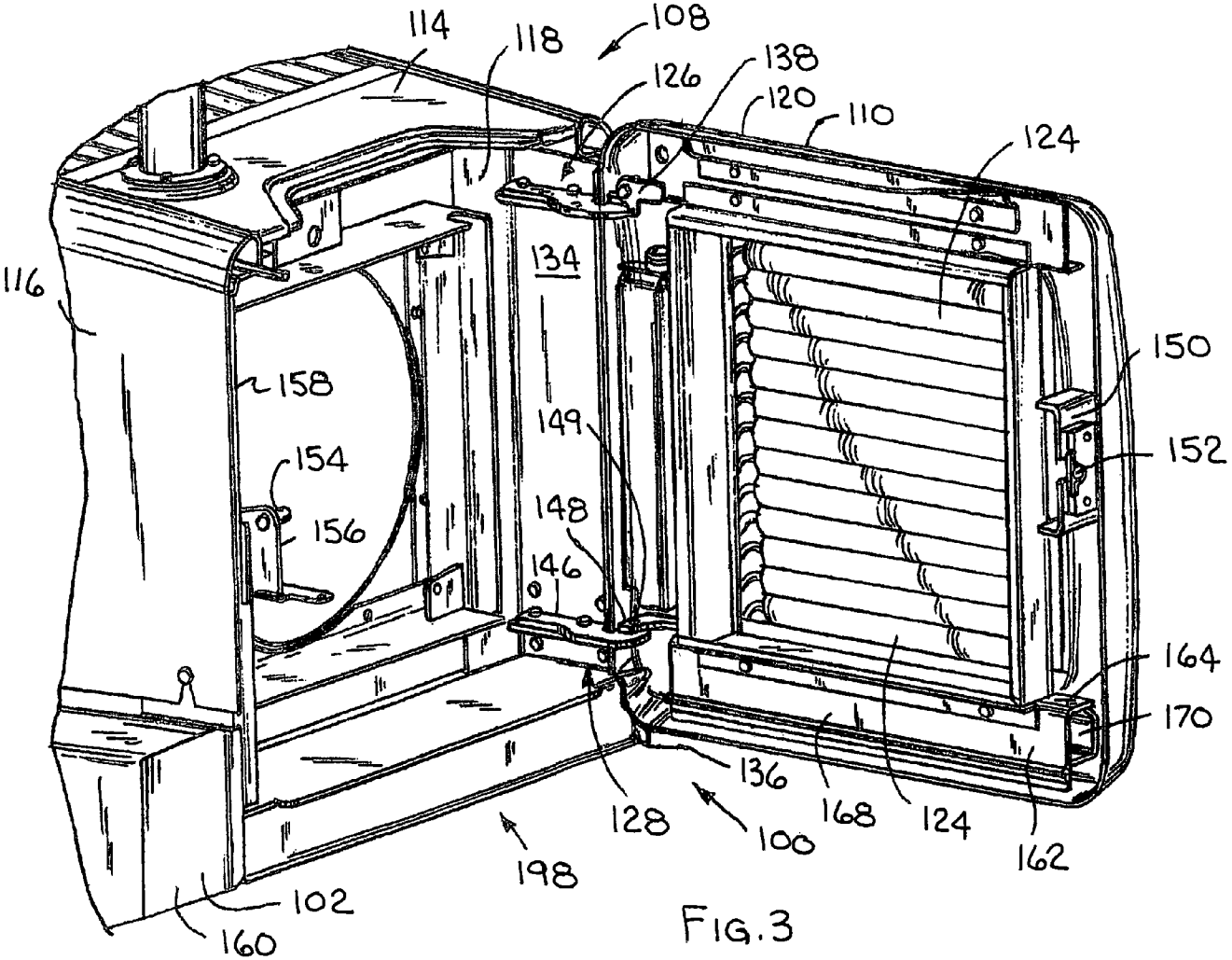
FIG. 3 is a fragmentary left side perspective rear view of the vehicle of FIGS. 1 and 2 with the rear door open showing the chassis interlock and the inner door construction including the hinges, louvers and latches.
Figure 4:
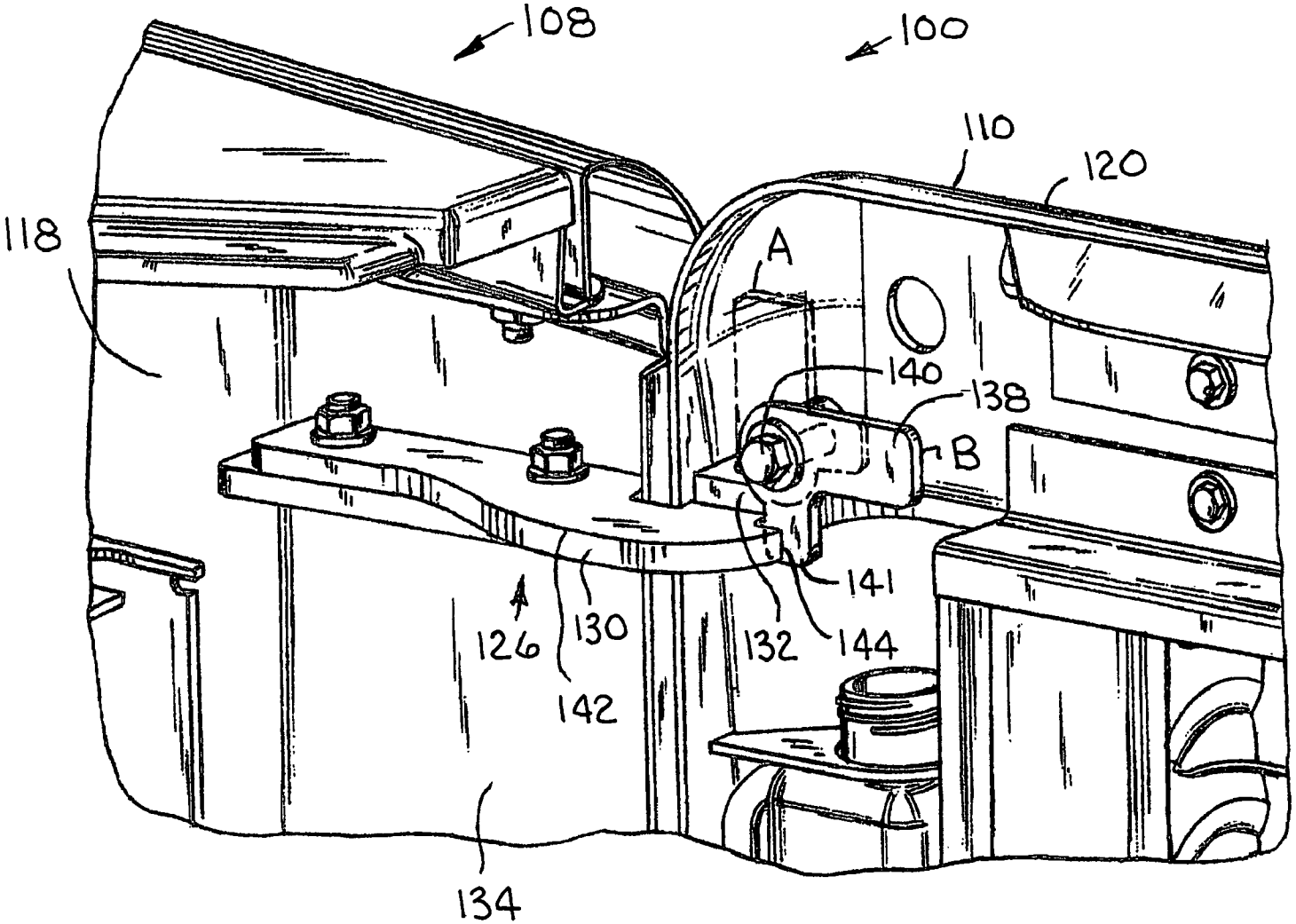
FIG. 4 is a fragmentary detailed perspective view of the upper hinge area of the vehicle shown in FIG. 3.

Referring now to FIGS. 3 and 4, latch 138 is pivotally coupled to door frame 120. It holds the door open in a first position, and permits the door to be closed in a second position. Latch 138 is pivotally mounted to door 110 by a bolt 140. As the door is opened, hinge plate 132, which is fixed to the door frame, pivots about hinge plate 130, which is fixed with respect to the chassis. Latch 138 pivots together with plate 132 and the door as the door is opened, with its tang 141 sliding along the top outer edge 142 of plate 130.

Latch 138 offers no resistance to this door opening, until the door is almost completely open (as shown in FIGS. 3 and 4), at which point a slot 144 in plate 130 moves underneath latch 138. Slot 144 is just wide enough to receive the outwardly extending tang 141. The weight of tang 141 unbalances latch 138, causing it to fall of its own weight into slot 144.

Latch 138 is shown in two positions in FIG. 4: a first unlatched position "A" shown in phantom lines, and a second latched position "B" shown in solid lines. Position "B" illustrates how the latch would appear when it has rotated about 90 degrees clockwise under the force of gravity. The latch is configured such that it is not perfectly balanced when in position "A", but is top heavy. The top heavy position is determined by the location of the hole in latch 138 through which bolt 140 passes. This hole is located such that latch 138 is not only top heavy, but tends to rotate in a clockwise direction (in FIG. 3), supported by top edge 142 of plate 130.

Lower hinge 128 similarly includes two plates 146, 148 and a pin 149 pivotally coupling the two plates together. These plates and pin are identically arranged to those of the upper hinge. Hinge plate 146 is bolted to vertical member 134. Plate 148 is fixed to door frame 120 and pivots together with the door frame when the door is opened.

The door hinges are preferably arranged so that the entire door may be removed from the vehicle by lifting the door upward until the hinge pins of the upper and lower hinges are removed from their corresponding hinge plates. The operator can stop the vehicle, open the door, lift the door upward from the bottom, and remove the door from vehicle 100.

A spring loaded door latch 150 is fixed to the opposite side of the door as hinges 126,128. It has a catch 152 that grasps a rod 154 extending from striker plate 156. Striker plate 156 is bolted to vertical member 158 that, in turn, is bolted to chassis member 160. The engagement of catch 152 and rod 154 prevents the door both from being opened and from being lifted off its hinges. When an upward force is applied to the closed door the catch and rod interengage to prevent the door from moving upward.

While the catch and rod are sufficiently strong to resist the force of one or two people trying to lift the closed door upward off its hinges, they may not be sufficient to prevent a substantial upward blow to the bottom of the door from lifting the door upward and either damaging the catch and rod, or damaging both the catch and rod, and the hinges, too.

To resist these more forceful blows or impacts from lifting the door and damaging the various door components, additional support structures are provided. These support structures include mechanically interengaging (or interlocking) members that resist the relative upward movement of the door with respect to the rest of the vehicle. These members are located at the bottom of the engine compartment opening and extend across the entire width of the opening.

These additional support structures are provided on both door and the chassis. They are configured to interlock automatically whenever the door is closed and disengage automatically whenever the door is opened. No additional operator activity is required to interlock these structures.

Figure 5:
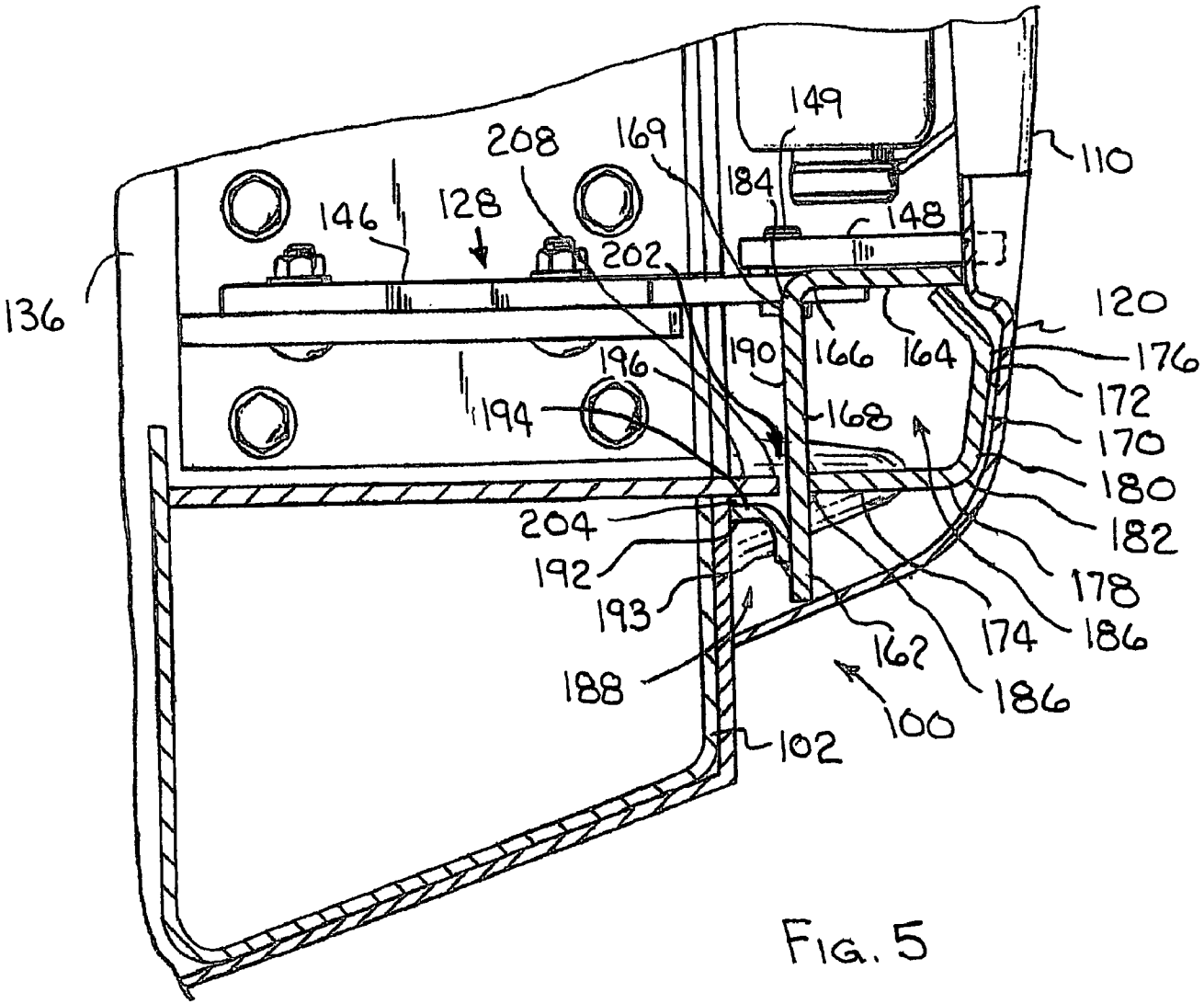
FIG. 5 is a fragmentary cross-sectional view of the rear door and chassis of the vehicle of the foregoing FIGURES when the door is in the closed position as shown in FIGS. 1 and 2 taken along section line 5 in FIG. 2.

FIGS. 3 and 5 show these structures in particular detail. In FIG. 3, they are shown as they would appear when the door is open and the structures are not mutually interengaged. In the positions shown in FIG. 3, the door can be lifted off the vehicle without damaging the door or the vehicle itself.

FIG. 5 shows the additional support structures as they are positioned when the door is closed. In FIG. 5 they are shown interlocked to resist the upward movement of the door.

Referring now to FIGS. 3 and 5, the structures include a first beam member 162 that is fixed to an inner surface of door frame 120 just below door opening 122. Member 162 may be permanently or removably fixed to door frame 120, such as by welding or bolting the member thereto.

Member 162 extends laterally, side-to-side, across the entire width of the engine compartment opening. It has the form of an L-shaped beam comprised to two major planar portions: a first planar portion 164 extending horizontally that is fixed along its laterally extending leading edge 166 to a vertically and laterally extending planar beam portion 168 having a top edge portion 169 that is fixed to edge 166.

Member 162 is fixed to a second beam member 170 that also extends laterally, side-to-side and is in turn fixed to the inner surface 172 of the lower portion of door frame 120 just below opening 122. Beam member 170 includes a first planar portion 174 that extends generally horizontally and laterally within door frame 120. It also includes a second planar beam portion 176 that extends generally laterally and vertically within door frame 120. Planar beam portions 174 and 176 are fixed together along a rearward and laterally extending edge 178 of beam portion 174 and along a bottom and laterally extending edge 180 of beam portion 176.

Beam portion 176 generally follows the contours of the inside rear surface 172 of door frame 120 just below door opening 122. Beam portion 176 preferably abuts and is fixed to the inside surface of door frame 120 over substantially its entire width to provide a relatively large area of support for the lower portion of the door. Since the lower portion of the door typically impacts such things as piles of dirt, sand, or rock first, it is the most prone to damage. Locating the beam members along (and fixing the beam members to) this lower portion of the door, provides particularly good protection against door damage.

While we describe edges 178 and 180 above as being fixed together, they need not be formed separately and then fixed together, but may be formed integrally from a single sheet of metal that is bent to form a laterally extending bend 182 that defines the junction between beam portions 174 and 176.

Similarly, beam member 162 may be formed from a single sheet of metal that is bent, thereby forming a laterally extending bend 184 at the junction of beam portion 164 and beam portion 168.

Beam member 162 and beam member 170 together form a generally rectangular box beam, having an internal, laterally extending, and generally rectangular hollow 186. This arrangement enhances the individual strength of beam members 162 and 170.

Beam member 162 and beam member 170 are fixed together to provide additional strength for the lower portion of door frame 120 and additional resistance to deformation when the door is impacted. As shown in FIG. 5, the two are fixed together by a weldment 187 that extends laterally, from side-to-side, inside door frame 120. While a weldment is preferred, the two components may be removably fixed together with bolts, for example. This arrangement can be employed to permit each beam to be more easily mounted to the door or to permit each beam to be adjusted with respect to the other.

A third component of the additional support structures is an elongated and laterally extending edge member 188 that is fixed to a forward facing vertical surface 190 of beam member 162. Edge member 188 includes a horizontally and laterally extending portion 192, shown here as a planar and linearly extending flange, that is coupled to a vertically and laterally extending portion 193, also shown as a planar and laterally extending flange.

Member 188 has a generally "L"-shaped form, commonly known as "angle iron" or "angle bracket" that is comprised of flanges 192 and 193, the two flanges being joined at right angles to one another along an upper edge of flange 193. Vertically extending flange 193 is fixed to vertical and forward facing surface 190 of member 162, preferably by welding.

Portion 192 has an upper surface 194 that is surmounted by an elongated interlocking member 196. Interlocking member 196 is shown in the FIGURES as a horizontally disposed planar sheet of steel that extends outward from the rear opening 198 (FIG. 5) of the engine compartment. Member 196 extends laterally across the engine compartment from one side to the other. Member 196 is fixed to and between the two elongate chassis members When door frame 120 is closed, member 196 is disposed immediately adjacent to and slightly above upper surface 194 of horizontally and laterally extending portion 192 of edge member 188. In this position, member 196 cooperates with surface 194 to prevent the door from moving upward when an upward force is applied to the door and he door is closed.

Member 196 and portion 192 extend substantially the entire distance across the engine compartment opening 198. This arrangement distributes the upward force of any door impact over substantially the entire width of the door, and over substantially the entire length of members 162 and 170.

Just as the additional support structures reduce damage to the door from being forced upward, they also reduce damage to the door by being forced forward and inward toward the engine compartment opening 198. When the door receives an impact that drives the door forward and generally into the engine compartment, vertically and laterally extending beam portion 168 of beam member 162 is forced forward against the rear edge 200 of member 196. This transfers the load on the door to the member 196 which is fixed to the vehicle chassis. When this impact occurs, edge 200 engages surface 190 of beam member 162 over substantially the entire width of the engine compartment opening.

The door is positioned by adjusting the positions of the hinges and the latch. For this reason, a narrow gap 202 is provided between rear-facing edge 200 and the forward-facing surface 190 of beam member 162. A similar narrow gap 204 is provided between upper surface 194 and the bottom surface of member 196. These two gaps extend laterally across the width of the engine compartment opening. The width of each gap 202,204 is preferably the same across the entire width of the engine compartment.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

We claim:

1. A rear engine compartment for a skid steer vehicle, comprising:

a left sidewall, a right sidewall, and a top wall that are fixed to a chassis of the skid steer vehicle and are disposed to enclose the engine and define a rear opening to the engine compartment;

a first elongated and laterally-extending beam fixed to the chassis, the first beam having a generally horizontal and downwardly facing surface extending from the rear opening; and a rear door pivotally coupled to the chassis, the door including a door frame and a second elongated and laterally-extending beam fixed to the door frame, the second beam having a generally horizontal and upwardly-facing surface, wherein the rear door is disposed to cover the rear opening and is supported by two hinges;

wherein the upwardly-facing surface and the downwardly-facing surface interlock over substantially their entire length to limit upward movement of the rear door with respect to the chassis.

2. The rear engine compartment of claim 1, wherein the first beam is fixed to and extends between two elongated chassis members disposed on either side of the engine.

3. The rear engine compartment of claim 2, wherein the first and second beams extend substantially the entire width of the rear opening, and are interlocked over substantially the entire width of the opening.

4. The rear engine compartment of claim 3 wherein the second beam has a box structure and includes an "L" -shaped angle bracket, wherein generally horizontal and upwardly-facing surface is on the angle bracket.

5. The rear engine compartment of claim 4, wherein an upper surface of the angle bracket extends across the width of the opening when the door is closed.

6. The rear engine compartment of claim 5, wherein the second beam includes a generally vertical, forward-facing and laterally extending surface to which the angle bracket is fixed, the forward-facing surface having a first surface portion that extends above the angle bracket and is disposed to transmit the force of forward impacts to the first beam.

7. The rear engine compartment of claim 1, wherein the first and second beams interlock with one another along the bottom of the opening.

* * * * *